US005792732A

United States Patent [19]

Jao et al.

[11] Patent Number: 5,792,732

[45] Date of Patent: Aug. 11, 1998

[54] LUBRICANTS WITH LINEAR ALKARYL OVERBASED DETERGENTS

[75] Inventors: Tze Chi Jao, Fishkill, N.Y.; Ingrid Christiane Denys, Poperingen, Belgium; Leonard Anthony Matthews, Port Arthur, Tex.; Nancy Anne Morton, Hopewell Junction, N.Y.

[73] Assignee: Ethyl Additives Corp., Richmond, Va.

[21] Appl. No.: 861,765

[22] Filed: May 22, 1997

Related U.S. Application Data

[63] Continuation of Ser. No. 641,691, May 2, 1996, abandoned, which is a continuation of Ser. No. 481,211, Jun. 7, 1995, abandoned, which is a continuation of Ser. No. 126,878, Sep. 27, 1993, abandoned.

[51] Int. Cl.[6] ..... C10M 159/24

[52] U.S. Cl. ..... 508/391

[58] Field of Search ..... 508/391

[56] References Cited

U.S. PATENT DOCUMENTS

| | | | |
|---|---|---|---|
| 3,764,533 | 10/1973 | Hunt et al. | 252/33 |
| 3,896,037 | 7/1975 | Dickey | 252/18 |
| 4,086,170 | 4/1978 | DeClippeleir et al. | 252/18 |
| 4,283,294 | 8/1981 | Clarke | 252/32.7 |
| 4,604,219 | 8/1986 | Whittle | 252/18 |
| 4,780,224 | 10/1988 | Jao | 508/401 |
| 4,822,502 | 4/1989 | Muir | 508/307 |
| 4,824,584 | 4/1989 | Muir et al. | 252/39 |
| 4,954,272 | 9/1990 | Jao et al. | 508/401 |
| 4,997,584 | 3/1991 | Jao et al. | 252/33 |
| 5,330,663 | 7/1994 | Wollenberg et al. | 252/18 |

FOREIGN PATENT DOCUMENTS

| | | | |
|---|---|---|---|
| 2 232 665 | 12/1990 | United Kingdom | 309/31 |

OTHER PUBLICATIONS

Graciaa et al., "HLB, CMC, and Phase Behavior as Related to Hydrophobe Branching", *Journal of Colloid and Interface Science*, vol. 89, No. 1 (Sep. 1982), pp. 209–216.

Baraket et al., "Criteria for Structuring Surfactants to Maximize Solubilization of Oil and Water, II Alkyl Benzene Sodium Sulfonates", *Journal of Colloid and Interface Science*, vol. 92, No. 2 (Apr. 1983), pp. 561–574.

*Primary Examiner*—Jerry D. Johnson

*Attorney, Agent, or Firm*—Dennis H. Rainear; Thomas Hamilton

[57] ABSTRACT

Lubricants containing overbased detergents with linear, alkyl substituted, aromatic component have superior water shedding and engine performance properties.

6 Claims, No Drawings

LUBRICANTS WITH LINEAR ALKARYL OVERBASED DETERGENTS

This is a continuation of U.S. patent application Ser. No. 08/641,691, filed May 2, 1996, now abandoned; which is a continuation of U.S. patent application Ser. No. 08/481,211, filed Jun. 7, 1995, now abandoned; which is a continuation of U.S. patent application Ser. No. 08/126,878, filed Sep. 27, 1993, now abandoned.

BACKGROUND OF THE INVENTION

1. Field of the Invention

This invention concerns lubricants containing specific detergent additives. More particularly, overbased detergents having linear mono- and/or dialkyl substitution provide lubricants with superior water shedding and engine performance.

2. Description of Related Information

During the combustion process in internal combustion engines, mineral and organic acidic by-products are produced. At the same time, other acidic products can also be generated by the degradation of lubricants used in internal combustion engines during engine operation. Such products attack and corrode engine parts leading to high temperature deposits on engine parts and low temperature sludge formation, resulting in increased wear of lubricated engine components. Basic substances are typically added to lubricants to neutralize the acidic products to avoid sludge formation and engine corrosion.

Overbased detergents are basic compounds which have been added to lubricant compositions to neutralize acidic degradation products. Overbased detergents are generally salts or complexes having a large excess of basic metal cation over that required to neutralize the oil-soluble anionic component of the detergent. Lubricants containing overbased detergent suitable for use in marine diesel engines are disclosed in U.S. Pat. No. 4,283,294 (Clarke).

Lubricants, like those used in marine diesel engines, require high levels of alkalinity, typically obtained using high concentrations of overbased detergents. Overbased detergents can have surfactant characteristics. Lubricant compositions containing high concentrations of such compounds will emulsify with water, generally found in marine applications. This emulsification reduces the ability of the lubricant composition to separate from water, known as "water shedding" or "water spitting". Diminished water shedding properties result in difficulties to remove water. The presence of water can cause additive instability and subsequently induce the formation of sludge and loss of lubricant. Linear, alkyl aromatic sulfonates have been used as emulsifiers, as described in U.K. Patent Application No. 2,232,665 (De Montlaur et al.).

Another important lubricant characteristic involves its effect on engine performance. Engine wear, ring sticking, and accumulation of deposits under operating conditions at high temperature are important properties influenced by lubricant performance. Optimally, lubricants should provide enhanced engine performance.

Surfactant properties of alkyl benzene sodium sulfonates, useful as overbased detergents, have been described, such as in an article entitled "Criteria for Structuring Surfactants to Maximize Solubilization of Oil and Water. II. Alkyl Benzene Sodium Sulfonates", by Barakat et al., Journal of Colloid and Interface Science, Volume 92, No. 2 (April 1983) on pp. 561–574. The impact of branching on water solubility and other surfactant properties has been described in an article entitled "HLB, CMC, and Phase Behavior as Related to Hydrophobe Branching", by Graciaa et al., Journal of Colloid and Interface Science, Volume 89, No. 1 (September 1982) on pp. 209–216. Processes for preparing overbased calcium sulfonates are described in U.S. Pat. No. 4,997,584 (Jao et al.) and U.S. patent application Ser. No. 07/636,475 (Jao et al.).

SUMMARY OF THE INVENTION

This invention concerns a lubricant composition comprising lubricating oil and an effective amount of overbased detergent. The overbased detergent is a salt of a linear alkaryl acid, like linear mono- or dialkyl, benzene or naphthalene, sulfonates or carboxylates.

DETAILED DESCRIPTION OF THE INVENTION

This invention provides lubricant compositions which significantly reduce emulsion problems, such as in marine applications. The lubricants also improve engine performance.

The lubricant composition comprises, and preferably consists essentially of, lubricating oil and certain overbased detergent compound.

The lubricating oil may be any, including known, material which has lubricating properties. The lubricating oil may be natural or synthetic, as well as mixtures of each. The lubricating oil may be unrefined compounds obtained directly from a natural or synthetic source, refined compounds from natural or synthetic sources which are treated in one or more purification steps, such as to improve one or more properties, or re-refined compounds from the reprocessing of used lubricants, as well as mixtures of unrefined, refined and/or re-refined compounds. Typical natural lubricating oils include, among others, one or mixtures of the following: liquid petroleum oils and hydrorefined, solvent-treated or acid-treated mineral lubricating oils, including paraffinic and/or naphthenic compounds such as N-100 Pale Oil from Texaco Inc. and SNO-100 and SNO-150 from Texaco Inc.; and the like. Typical synthetic lubricating oils include, among others, one or mixtures of the following: polyalphaolefins such as EMERY® 3004 and 3006 PAO Basestocks from Quantum Chemical Corp. and MOBIL® SHF-42 from Mobil Chemical Co.; diesters such as EMERY® 2960 and 2971 Synthetic Lubricant Basestocks from Quantum Chemical Corp. and MOBIL® Esters DB-41 and DB-51 from Mobil Chemical Co.; polyol esters, such as made by reacting dicarboxylic acids, glycols and either monobasic acids or monohydric alcohols, like EMERY® 2936 Synthetic Lubricant Basestocks from Quantum Chemical Corp. and MOBIL® Ester P-24 from Mobil Chemical Co.; silicone oils; and the like.

The detergent is an overbased salt of a linear alkaryl acid. The term "overbased" means that the compound has a stoichiometric excess of base beyond the amount required to neutralize the acid component in the detergent. Any, including known, salt of a linear alkaryl acid which is useful as a detergent in lubricant compositions may be used. The detergent is a salt complex which when a carbonate can have a structure as shown in Formula 1, or like material.

$$(M^{+v}(OH)_v)_m(M_{3-v}^{+v})_n(M^{+v}Y_v^-) \qquad \text{Formula 1. Detergent}$$

In Formula 1, $M^{+v}$ is a metal, typically an alkali or alkaline earth metal, cation having a valence, given by v, of 1 or 2.

Typical M cations include among others, one or mixtures of the following: lithium, sodium, potassium, magnesium, barium, strontium and, preferably, calcium. $Y^-$ is a, typically oil-soluble, linear alkaryl anion. The alkyl portion can have either a saturated or unsaturated hydrocarbon chain. Typical Y include, among others, one or mixtures of the following: linear alkaryl sulfonates, such as sulfonated, linear mono- or dialkyl-substituted, aromatic hydrocarbons; linear alkaryl carboxylates; linear alkyl phenates; linear alkyl salicylates; and the like. The linear alkaryl group is an aromatic hydrocarbon having alkyl substitution. The aromatic portion may have other substituents, such as hydroxyl. The alkyl group has a linear, as opposed to branched, chain of carbon atoms, and when saturated, generally contains a chain of methylene, i.e. $—CH_2—$, groups. One or more alkyl substituent may be present, providing mono-, di- or higher alkyl substitution on the aromatic ring. Typical monoalkyl groups have at least 15, preferably from about 16 to about 40, and optimally from about 18 to about 24, carbon atoms. Typical dialkyl substitution has at least 18, and preferably from about 20 to about 50, and optimally from about 20 to about 30, carbon atoms. Typical aromatic groups include benzene, phenol, naphthalene, and toluene.

The detergent is said to be overbased when the sum of m+n in Formula 1 is more than about 0.5 per detergent molecule. The amount of overbasing may vary depending upon which cation and anion are used. For example, the amount of overbasing for alkaryl sulfonates generally ranges from above 0.5 up to about 30, preferably from about 5 to about 20, and optimally from about 8 to about 12. The detergent can have a Total Base Number (TBN), defined as the milligram equivalents of potassium hydroxide per gram of product, typically ranging from about 25 to about 500.

The amount of detergent may be any amount which is effective at providing the detergency properties of this invention, and may vary depending upon the particular overbased detergent, lubricant and its use. Typically, the lubricant composition will contain from about 0.1 to about 25, preferably from about 0.8 to about 20, and optimally from about 1.5 to about 15, weight percent of overbased detergent.

The detergent can be overbased by any, including known, manner. For example, overbased carbonate detergent can be made by carbonating the linear alkaryl salt, generally in the presence of diluent solvent and promotor. One or mixtures of carbonating compounds, like $Ca(OH)_2$ and CaO, are added until the desired level of carbonation and TBN is achieved.

Mixtures of alkyl substituents include combinations of mono- and dialkyl substituents. The proportion of mono- to dialkyl substitution can typically range from about 90:10 to about 30:70, preferably from about 80:20 to about 40:60, and optimally about 70:30, mole percent.

Other materials may optionally be included in the lubricant composition. These materials include, among others, one or mixtures of the following. VI improvers can be present, such as any material effective at improving the viscosity properties of the lubricant like: polyolefins like TLA-525 from Texaco Chemical Co.; dispersant polyolefins like TLA-7200 from Texaco Chemical Co.; polymethacrylates like TLA-374 from Texaco Chemical Co.; hydrogenated polyisobutylene star polymers like SHELLVIS® 250 from Shell Chemical Co.; and the like. Other detergents can be present, such as oil soluble surfactants including compounds similar to the previously described overbased detergents without overbasing, such as where m+n in Formula 1 is less than or equal to about 0.5 per detergent molecule; and the like. Corrosion inhibitors can be present, such as any material effective at reducing degradation of metal contacted by the lubricant, like: phosphosulfohydrocarbons, meaning hydrocarbons containing phosphorus and sulfur, such as made by reacting hydrocarbon, such as terpene with phosphorus sulfide using any effective, including known, procedure; borate esters; thiadiazoles such as derivatives of 2,2-dimercapto-1,3,4-thiadiazole and benzotriazoles; and the like. Antioxidants can be present, such as any material effective in reducing lubricant deterioration from oxidation, like: dihydrocarbyl dithiophosphate metal salts; copper salts; aromatic amines like alkylated diphenylamines and phenyl alpha naphthylamine; hindered phenols; alkaline earth metal salts of alkylphenolthioesters like calcium nonyl phenol sulfide, barium t-octyl phenyl sulfides, dioctyl phenyl-amine, phosphosulfurized or sulfurized hydrocarbons; and the like. Pour point depressants can be present, such as any material effective at lowering the temperature at which the lubricant flows or can be poured, including: dialkyl fumarate vinyl acetate copolymers; polymethacrylates; wax naphthalene; and the like. Anti-foamants can be present, such as any material which reduces lubricant foaming, including: polysiloxanes like silicone oil and polydimethyl siloxane; and the like. Antiwear agents can be present, such as any material effective at reducing the wear of material contacted by the lubricant, including: dihydrocarbyl dithiophosphate metal salts as described previously; borate esters and thiadiazoles as previously described; and the like. Friction modifiers can be present, such as any material influencing the friction characteristics of the lubricant, like: automatic transmission fluids; fatty acid esters and amides; glycerol esters of dimerized fatty acids; and the like. Any other materials useful in lubricant compositions can also be present.

The lubricating oil, overbased detergent, and any other optional ingredients, can be combined to make lubricant composition using any, including known, effective procedure such as mixture together under ambient conditions.

The lubricant compositions can be used wherever lubricants are useful, like marine trunk piston engine oils, marine diesel cylinder oils, heavy-duty diesel engine oil, passenger car motor oils, and the like. The lubricants are particularly suitable for marine applications or other uses requiring high alkalinity, demulsifying, or water shedding properties.

The following examples illustrate some embodiments of this invention and are not intended to limit its scope. All percentages given in the disclosure and claims are in weight percent, unless otherwise stated.

EXAMPLES

Terms used in the examples have the following meanings:

| Term | Meaning |
|---|---|
| Acid A | Linear mono (nominally $C_{18-20}$) alkyl, benzene sulfonic acid in oil, available as MixOil ® 1245 from MixOil, S.p.A., having 91% acid. |
| Acid B | Linear mono alkyl, nominally $C_{18-20}$ alkyl, benzene sulfonic acid in oil, available as MixOil ® 1245 from MixOil, S.p.A., having 87% acid. |
| Detergent A | Nominal 300 TBN overbased sulfonate having a highly branched alkylate and small amount of linear dialkyl benzene sulfonate, available as LZ-6477 or Amoco 9243 from Amoco Chemical Co. |
| Detergent B | Nominal 300 TBN overbased sulfonate containing about 50% petroleum sulfonate having highly branched alkyl substitution and 50% linear dialkyl benzene |

-continued

| Term | Meaning |
|---|---|
| | sulfonate, available as TLA-1421 from Texaco Inc. |
| Detergent C | Nominal 500 TBN overbased sulfonate containing highly branched alkyl benzene sulfonate, available as Petronate ® C-500 from Witco Corp. |
| Detergent D | Linear dialkyl (nominally dodecyl) benzene sulfonate available as Petronate ® C-50N from Witco Corp. |
| Detergent E | Nominal 300 TBN linear monoalkyl benzene sulfonate, available as MX-4325 from MixOil, S.p.A. |
| Detergent F | Nominal 300 TBN sulfonate which is an equal weight mixture of Detergent A and Detergent E. |

Unless otherwise indicated, test results given in the examples are based on the following procedures:

Demulsibility Tests: The demulsibility tests measure the demulsibility of lubricants. In Test Method A, 27 ml of test lubricant and 53 ml of distilled water are placed in a 100 ml graduated cylinder having a 2.86±0.04 cm inside diameter. The cylinder is placed in a water bath at 82° C. vertically to a depth up to the 85 ml mark. The test fluid is stirred for five minutes using a motorized paddle rotating vertically around its longitudinal axis at a speed of 1500 rpm inside the cylinder. The paddle is removed after stirring. The volumes of the three defined layers of clear oil, lubricant emulsion, and water are measured over time. In Test Method B, 40 ml of an emulsifying liquid, which is an aqueous solution having 1 weight percent sodium chloride and 1 normal sodium hydroxide, are placed in a graduated cylinder as used in Test A. 40 ml of the test lubricant are added and the cylinder is placed in a water bath at 82° C., stirred, and measured as described in Test A.

Diesel Engine Test: Diesel engine performance is tested using the standard MWM-B procedure described in CEC-L12A-76 of the Coordinating European Committee for the Development of Performance Tests for Lubricants in Engine Fuels, and DIN51361 (Part 4) of the German Institute for Standardization. The test involves running an engine for the standard test hours to evaluate the lubricant's effect on ring sticking, wear, and accumulation of deposits under high temperature conditions. Test results are given in the standard merit rating.

KV: Kinematic viscosity is determined by ASTM Test Method D445 for automatic viscosity measurements at 100° C., given in centistokes (cSt).

TBN: The total base number is determined by ASTM D-2896, given in milligrams of potassium hydroxide per gram of detergent (mg KOH/g).

EXAMPLE 1:

Making 300 TBN All-Linear Alkylbenzene Sulfonate

Charge 32.56 grams of Acid A into a 1-liter, 4-neck reaction flask. Add 30.08 grams 100P pale oil, 30.53 grams Detergent D, 174.0 grams n-heptane, 24.48 grams methanol, 3.95 grams $Ca(OH)_2$ and 0.2 gram $CaCl_2$. Heat the reaction mixture with constant stirring at 50° C. for one hour. After heating, verify the completion of neutralization by observing the disappearance of an IR band around 900 $cm^{-1}$. Add 20.90 grams CaO and 18.42 grams $Ca(OH)_2$ to the reaction mixture. Raise the reaction temperature to 60° C. Add 1.4 ml $H_2O$ to the reaction mixture immediately before the addition of $CO_2$ by bubbling the mixture with $CO_2$ at a rate of 88 ml/min for 135 minutes. Add 23.75 grams 100P pale oil to 250 ml crude product after filtration and before stripping solvent. The finished product has a TBN of 315.

EXAMPLE 2:

Making 500 TBN All-Linear Alkylbenzene Sulfonate

Charge 19.71 grams of Acid B into a 1-liter, 4-neck reaction flask. Add 17.0 grams 100P pale oil, 52.66 grams Detergent D, 182.0 grams n-heptane, 18.96 grams methanol, and 2.40 grams $Ca(OH)_2$. Heat the reaction mixture with constant stirring at 50° C. for one hour. After heating, verify the completion of neutralization by observing the disappearance of an IR band around 900 $cm^{-1}$. Add 42.64 grams CaO and 37.56 grams $Ca(OH)_2$. Raise the reaction temperature to 60° C. Add 3.6 ml water immediately before adding $CO_2$ by bubbling the mixture with $CO_2$ at 188 ml/min for 135 minutes. Filter the crude product. Add approximately 15 grams 100P pale oil to 200 ml crude product before stripping off the solvent. The finished product has a TBN of 507.

The detergents are analyzed using previously described demulsibility test procedure, Test Methods A and B, with the results shown in Tables I and II, respectively.

TABLE I

Demulsibility of Various Overbased Detergents[a]

| Detergent: Minutes | A O: W: E | Example 1 O: W: E | B O: W: E | C O:W:E | Example 2 O: W: E |
|---|---|---|---|---|---|
| 10 | 1:0:79 | 10:10:60 | 1:0:79 | 1:0:79 | 0:41:39 |
| 15 | 5:4:71 | 20:20:40 | 5:9:66 | 1:0:79 | 1:45:34 |
| 30 | 10:10:60 | 27:50:3 | 29:28:13 | 1:0:79 | 1:51:28 |
| 32 | | 27:53:0 | | | 27:53:0 |
| 45 | 20:33:27 | | 27:51:3 | 2:0:79 | 27:53:0 |
| 59 | 27:53:0 | | | | |
| 63 | | | 27:51:3 | 1:0:79 | |

Note for Table I:
[a]values are given in millimeters of oil, water, and emulsion (O:W:E) after designated minutes, using Test Method A.

TABLE II

Demulsibility of Various Overbased Detergents[a]

| Detergent: Minutes | A O:W:E | Example 1 O: W: E | B O:W:E |
|---|---|---|---|
| 10 | 0:1:79 | 0:1:79 | 0:0:79 |
| 15 | 0:1:79 | 0:2:78 | 0:2:78 |
| 30 | 0:1:79 | 12:33:35 | 0:2:78 |
| 45 | 0:1:79 | 29:40:11 | 0:2:78 |
| 60 | 0:1:79 | 38:40:2 | 0:2:78 |

Note for Table II:
[a]values are given in millimeters of oil, water, and emulsion (O:W:E) after designated minutes, using Test Method B.

Table I shows that the demulsibility of either Detergent A or Detergent B is not as good as that of the Example 1 detergent of this invention. The blend containing the detergent of this invention completely clears up the emulsified layer and settles into the oil and water layers within 32 minutes after the stirring stops, while the other two take about an hour to achieve the same performance. Table I also shows that the highly overbased, Example 2 detergent derived from all-linear alkylate of this invention has better demulsibility than a comparably overbased Detergent C, which contains highly branched alkyl substitution. Table II shows that the blend containing the Example 1 detergent derived from all-linear alkylate of this invention has less emulsifying tendency because the emulsified layer clarified in one hour, while Detergent A, which contains highly branched alkyl substitution, has strong emulsifying characteristics.

EXAMPLE 3:

Making 300 TBN Linear Dialkyl Benzene Sulfonate

Charge 478.8 grams of Detergent D into a 5-liter, 4-neck reaction flask equipped with a water cooled condenser. Add 870.0 n-heptane and 122.4 grams methanol and mix well. Add 108.3 grams CaO, 25.2 grams $Ca(OH)_2$, and 1.0 grams $CaCl_2$. Turn on the condenser. Heat the reaction mixture to 60° C. with constant stirring. Add 7 ml $H_2O$ immediately before the addition of $CO_2$ by bubbling the reaction mixture with $CO_2$ at 410 ml/min for 155 minutes. Filter and strip the solvent. The finished product has a TBN of 326.

EXAMPLE 4:

Making Mono and Dialkyl Benzene Sulfonates Mixture

A nominal 300 TBN detergent which is a mixture of sulfonates is prepared by mixing 210 grams of (monoalkyl) Detergent E with 78 grams (dialkyl) detergent made in Example 3. The mixture has a 70:30 mole ratio of mono- to dialkyl sulfonates.

TABLE III

MWM-B Test Results of Individual and Mixed Sulfonates[a]

| Detergent: | Ex. 1 | Ex. 3 | Ex. 4 | A | E | F |
|---|---|---|---|---|---|---|
| KV (cSt) | 14.9 | 15.0 | 14.8 | 14.9 | 14.9 | 14.9 |
| TBN (mg KOH/g) | 10.4 | 10.9 | 11.0 | 11.1 | 11.1 | 10.8 |
| MWM-B (merits)[b] | 67.5[c] | 66.7 | 63.4 | 63.4 | 51.6 | 60.9 |

Notes for Table III:
[a]The sulfonate components are evaluated in a high performance, SAE 15W40, diesel engine oil containing 1.5% ash.
[b]A value of 65 or higher is considered good, while a value of 55 or lower is considered poor.
[c]Having a repeat run value of 83.0.

The results in Table III show that the diesel engine performance of Detergent E is low. The diesel engine performance of Example 3 detergent is high. However, the diesel engine performance of Example 1 detergent at 67.5 is much higher than expected by direct, linear interpolation between the values for each component within the mixture of Example 4, namely Detergent E and that made in Example 3. This detergent would be expected to have a MWM-B merit reading of around 55. Even Example 4 detergent, made by just physically mixing Detergent E with that of Example 3, has a higher than expected MWM-B merit reading of 63.4. Mixing the linear monoalkyl benzene sulfonate and linear dialkyl benzene sulfonate before overbasing gives an additional improvement in engine performance. In contrast, Detergent F, which is a mixture of Detergent E with Detergent A, does not show any such improvement in diesel engine performance.

What is claimed is:

1. A lubricant oil composition for marine application or applications requiring alkalinity, demulsifying or water shedding properties comprising a lubricating oil and an effective amount for providing detergency properties of at least one overbased detergent which is an amorphous salt of a linear alkaryl acid wherein aryl is selected from the group consisting of benzene and naphthalene, wherein the detergent has a total base number of from about 25 to about 300 and wherein the detergent is sulfonated and contains a mixture of linear monoalkaryl groups and linear dialkaryl groups.

2. The composition of claim 1 wherein the detergent is a mixture of a linear monoalkyl benzene sulfonate and a dialkyl benzene sulfonate.

3. The composition of claim 2 wherein the detergent contains about 70 mole percent monoalkyl benzene sulfonate and about 30 mole percent dialkyl benzene sulfonate.

4. The composition of claim 2 wherein the alkyl group of the linear monoalkyl benzene sulfonate is nominally $C_{18-20}$.

5. The composition of claim 2 wherein the alkyl groups of the dialkyl benzene sulfonate are nominally $C_{12}$.

6. The composition of claim 1 wherein the detergent is a calcium salt.

* * * * *